US007755290B2

(12) United States Patent
Yim et al.

(10) Patent No.: US 7,755,290 B2
(45) Date of Patent: Jul. 13, 2010

(54) MICRO DISCHARGE (MD) PLASMA DISPLAY PANEL INCLUDING ELECTRODE LAYER DIRECTLY LAMINATED BETWEEN UPPER AND LOWER SUBTRATES

(75) Inventors: Sang-Hoon Yim, Yongin-si (KR); Yoon-Chang Kim, Yongin-si (KR); Min-Suk Lee, Yongin-si (KR); Hyoung-Bin Park, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 632 days.

(21) Appl. No.: 11/516,059

(22) Filed: Sep. 6, 2006

(65) Prior Publication Data

US 2007/0063653 A1 Mar. 22, 2007

(30) Foreign Application Priority Data

Sep. 7, 2005 (KR) ..... 10-2005-0083108

(51) Int. Cl.
*H01J 17/16* (2006.01)

(52) U.S. Cl. ..... 313/618; 313/631; 313/582

(58) Field of Classification Search ..... None
See application file for complete search history.

(56) References Cited

U.S. PATENT DOCUMENTS 3,956,667 A * 5/1976 Veith ..... 345/72
4,130,778 A * 12/1978 Branston ..... 315/169.4
4,340,838 A * 7/1982 Kobale et al. ..... 313/348
5,541,618 A 7/1996 Shinoda
5,661,500 A 8/1997 Shinoda et al.
5,663,741 A 9/1997 Kanazawa (Continued)

FOREIGN PATENT DOCUMENTS

FR 2265172 10/1975

(Continued)

OTHER PUBLICATIONS

European Search Report for European Patent Application No. 06119912.1-2208 issued on Dec. 12, 2006.

(Continued)

*Primary Examiner*—Toan Ton
*Assistant Examiner*—Britt D Hanley
(74) *Attorney, Agent, or Firm*—Robert E. Bushnell, Esq.

(57) ABSTRACT

A Plasma Display Panel (PDP) includes a dielectric layer having a plurality of dielectric-layer perforated holes arranged in a matrix; and upper and lower electrode layers having electrode-layer perforated holes connected to the dielectric-layer perforated holes and arranged on both surfaces of the dielectric layer; the upper electrode layer includes a plurality of first electrodes extending in a first direction, the plurality of first electrodes surrounding a group of electrode-layer perforated holes arranged in the first direction; and the lower electrode layer includes a plurality of second electrodes extending in a second direction different from the first direction, the plurality of second electrodes surrounding a group of electrode-layer perforated holes arranged in the second direction. Individual electrodes surrounding the electrode-layer perforated holes protrude from the dielectric layer toward the centers of the perforated holes such that a facing discharge is generated between the upper and lower individual electrodes, resulting in a PDP having stable characteristics and high efficiency and having a simple structure.

11 Claims, 2 Drawing Sheets

U.S. PATENT DOCUMENTS

| | | | | |
|---|---|---|---|---|
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,061,074 | A * | 5/2000 | Bartha et al. | 347/123 |
| 6,069,446 | A | 5/2000 | Kim | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 2002/0167275 | A1 * | 11/2002 | Bechtel et al. | 313/587 |
| 2003/0230983 | A1 * | 12/2003 | Vonallmen | 315/111.21 |
| 2005/0127838 | A1 | 6/2005 | Amano | |
| 2007/0052359 | A1 * | 3/2007 | Yim et al. | 313/582 |
| 2007/0210709 | A1 * | 9/2007 | Yim et al. | 313/582 |

FOREIGN PATENT DOCUMENTS

| | | |
|---|---|---|
| JP | 2-132731 | 5/1990 |
| JP | 2845183 | 10/1998 |
| JP | 2917279 | 4/1999 |
| JP | 2001-043804 | 2/2001 |
| JP | 2001-325888 | 11/2001 |
| JP | 2002-156940 | 5/2002 |
| JP | 2005-174684 | 6/2005 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. In 2003, and Appendix A—Description of Technology, Annex B—Relationship Between Voltage Terms And Discharge Characteristics; Annex C—Gaps and Annex D—Manufacturing.

* cited by examiner

MICRO DISCHARGE (MD) PLASMA DISPLAY PANEL INCLUDING ELECTRODE LAYER DIRECTLY LAMINATED BETWEEN UPPER AND LOWER SUBTRATES

CLAIM OF PRIORITY

This application makes reference to, incorporates the same herein, and claims all benefits accruing under 35 U.S.C.§119 from an application for PLASMA DISPLAY PANEL OF MICRO DISCHARGE TYPE earlier filed in the Korean Intellectual Property Office on the 7 of Sep. 2005 and there duly assigned Ser. No. 10-2005-0083108.

BACKGROUND OF THE INVENTION

1. Field of the Invention

The present invention relates to a Plasma Display Panel (PDP), and more particularly, to a Micro Discharge (MD) PDP, which includes a dielectric layer having a plurality of dielectric-layer perforated holes arranged in a matrix and electrode layers provided on the upper and lower surfaces of the dielectric layer and having a plurality of electrode-layer perforated holes corresponding to the dielectric-layer perforated holes.

2. Description of the Related Art

A Plasma Display Panel (PDP) is formed by forming barrier ribs and electrodes on two substrates, attaching the two substrates to each other with a gap therebetween, injecting a discharge gas therebetween and sealing the two substrates. A plasma display device is a flat display device including a PDP and mounting elements necessary for implementing a screen, such as a driving circuit connected to the electrodes of the PDP.

In the PDP, numerous pixels for displaying the screen are regularly arranged in a matrix. In the PDP, the pixels are driven by supplying voltages to the electrodes without an active element, that is, in a passive matrix manner. PDPs are classified as Direct Current (DC) PDPs and Alternating Current (AC) PDPs, depending on a voltage signal for driving the electrodes. Alternatively, PDPs are classified into facing type PDPs and surface discharge PDPs, depending on the arrangement of two electrodes to which a discharge voltage is supplied.

A surface light emitting source using a plasma discharge includes a Micro Discharge (MD) and a Micro Hollow Cathode Discharge (MNCD).

An open Micro Discharge (MD) PDP is composed of three layers: upper and lower electrode layers for receiving a voltage and a dielectric layer for forming a space between the upper and lower electrode layers. A plurality of perforated holes are formed in the upper and lower electrode layers and the dielectric layer. The upper and lower electrode layers are formed in a flat plate shape except for the perforated holes and are integrally formed. Accordingly, if at least a predetermined voltage is supplied across the upper and lower electrodes, a surface discharge is generated between the two electrode layers in the perforated holes. If the perforated holes have an adequate size, a stable and efficient plasma discharge can be generated in the perforated holes.

When the discharge is generated, light is emitted from the perforated holes. In general, phosphor layers for increasing emission efficiency are formed in the perforated holes and the MD PDP operates in a specific gas atmosphere. Such a MD PDP is a surface light source and can be used as a backlight source of non-self-luminous display device, such as a Liquid Crystal Display (LCD).

However, the MD PDP having the configuration noted above has the same shape as that of a typical capacitor having a dielectric inserted between two electrodes. Accordingly, when an AC voltage is supplied across the two electrode layers, power is unnecessarily consumed due to parasitic capacitances.

Since a stable and efficient plasma discharge can be generated in the perforated holes when the perforated holes have an adequate size, and since the MD PDP noted above has a shape similar to that of an initial matrix PDP, a PDP using a Micro Discharge (MD) structure may be tried to be manufactured.

SUMMARY OF THE INVENTION

The present invention has been made to overcome the aforementioned problems, and an object of the present invention is to provide a Plasma Display Panel (PDP) using a Micro Discharge (MD) structure.

Another object of the present invention is to provide a Plasma Display Panel (PDP) having a Micro Discharge (MD) structure, which can increase discharge efficiency and reduce parasitic capacitance.

Another object of the present invention is to provide a Plasma Display Panel (PDP) having a Micro Discharge (MD) shape, which can prevent a phosphor from deteriorating while generating a facing surface.

According to an aspect of the present invention, a Plasma Display Panel (PDP) is provided including: a dielectric layer having a plurality of dielectric-layer perforated holes arranged in a matrix; and upper and lower electrode layers having electrode-layer perforated holes connected to the dielectric-layer perforated holes and arranged on both surfaces of the dielectric layer; the upper electrode layer includes a plurality of first electrodes extending in a first direction, the plurality of first electrodes surrounding a group of electrode-layer perforated holes arranged in the first direction; and the lower electrode layer includes a plurality of second electrodes extending in a second direction different from the first direction, the plurality of second electrodes surrounding a group of electrode-layer perforated holes arranged in the second direction.

At least one of each first electrode and each second electrode preferably includes individual electrodes surrounding the electrode-layer perforated holes and a connection portion to connect the individual electrodes.

The dielectric-layer perforated holes are preferably arranged in either a lattice array or a delta array.

Upper and lower substrates are preferably arranged outside of the upper and lower electrode layers, peripheries of the upper and lower substrates hermetically seal a space between the upper and lower substrates, and a discharge gas is contained within the space between the upper and lower substrates.

A phosphor layer is preferably arranged on at least portions of the upper and lower substrates facing the perforated holes.

The size of the dielectric-layer perforated holes is preferably greater than that of the electrode-layer perforated holes such that at least portions of the upper and lower electrode layers protrude from the inner surfaces of the dielectric-layer perforated holes toward the centers of the dielectric-layer perforated holes.

A phosphor layer is preferably arranged only on the inner surfaces of the electrode-layer perforated holes of at least one of the upper and lower electrode layers and the inner surfaces of the substrates facing the electrode-layer perforated holes.

The phosphor layer arranged on one of the substrates serving as a visible screen preferably includes a transparent phosphor layer.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
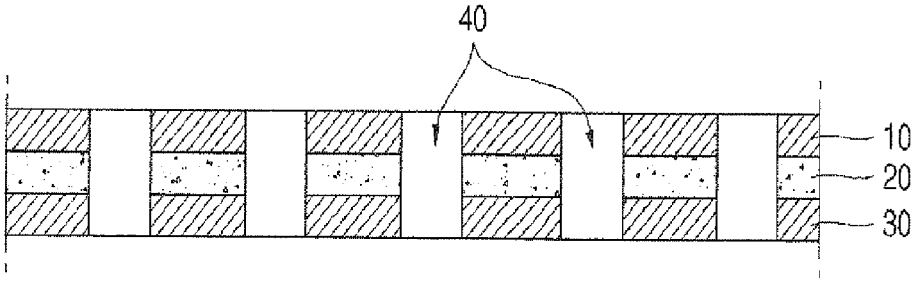
FIG.1 (Prior Art)
FIG. 1 is a side cross-sectional view of a Micro Discharge Plasma Display Panel (MD PDP)

FIG. 1 is a side cross-sectional view of an open Micro Discharge Plasma Display Panel (MD PDP).

The MD PDP is composed of three layers: upper and lower electrode layers 10 and 30 for receiving a voltage and a dielectric layer 20 for forming a space between the upper and lower electrode layers 10 and 30. A plurality of perforated holes 40 are formed in the upper and lower electrode layers 10 and 30 and the dielectric layer 20. The upper and lower electrode layers are formed in a flat plate shape except for the perforated holes 40 and are integrally formed. Accordingly, if at least a predetermined voltage is supplied across the upper and lower electrodes, a surface discharge is generated between the two electrode layers in the perforated holes. If the perforated holes have an adequate size, a stable and efficient plasma discharge can be generated in the perforated holes.

When the discharge is generated, light is emitted from the perforated holes. In general, phosphor layers for increasing emission efficiency are formed in the perforated holes and the MD PDP operates in a specific gas atmosphere. Such a MD PDP is a surface light source and can be used as a backlight source of non-self-luminous display device, such as a Liquid Crystal Display (LCD).

However, the MD PDP having the configuration of FIG. 1 has the same shape as that of a typical capacitor having a dielectric inserted between two electrodes. Accordingly, when an AC voltage is supplied across the two electrode layers, power is unnecessarily consumed due to parasitic capacitances.

Since a stable and efficient plasma discharge can be generated in the perforated holes when the perforated holes have an adequate size, and since the MD PDP of FIG. 1 has a shape similar to that of an initial matrix PDP, a PDP using a Micro Discharge (MD) structure may be tried to be manufactured.

Hereinafter, exemplary embodiments of the present invention are described in detail below with reference to the accompanying drawings.

Figure 2:
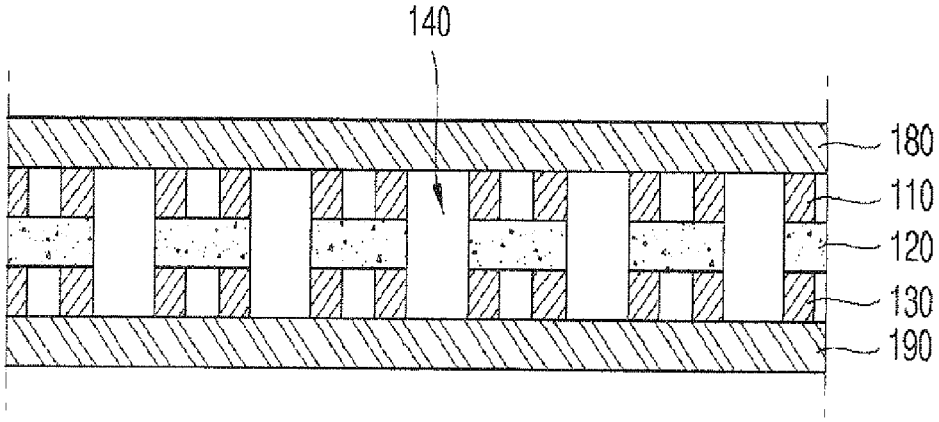
FIG. 2 is a side cross-sectional view of a PDP according to an embodiment of the present invention.

FIG. 2 is a side cross-sectional view of a Plasma Display Panel (PDP) according to an embodiment of the present invention.

Figure 3:
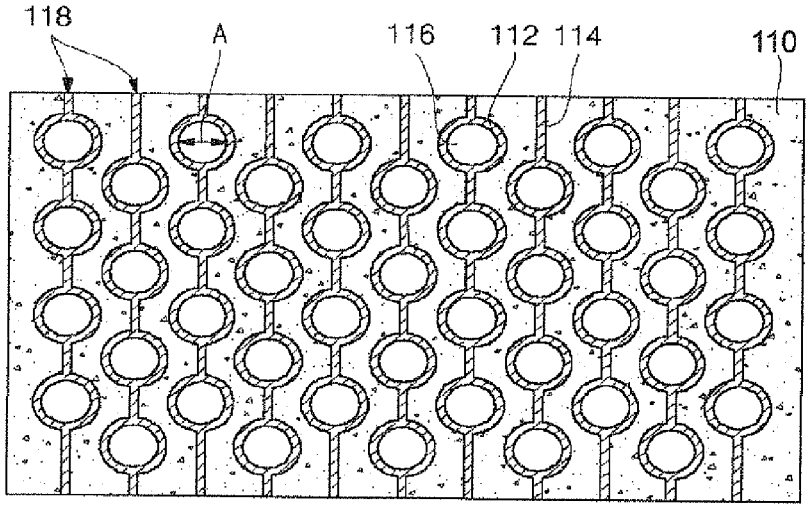
FIGS. 3 through 5 are respective plan views of an upper electrode layer, a lower electrode layer, and a dielectric layer of the PDP according to the embodiment of the present invention.
Figure 4:
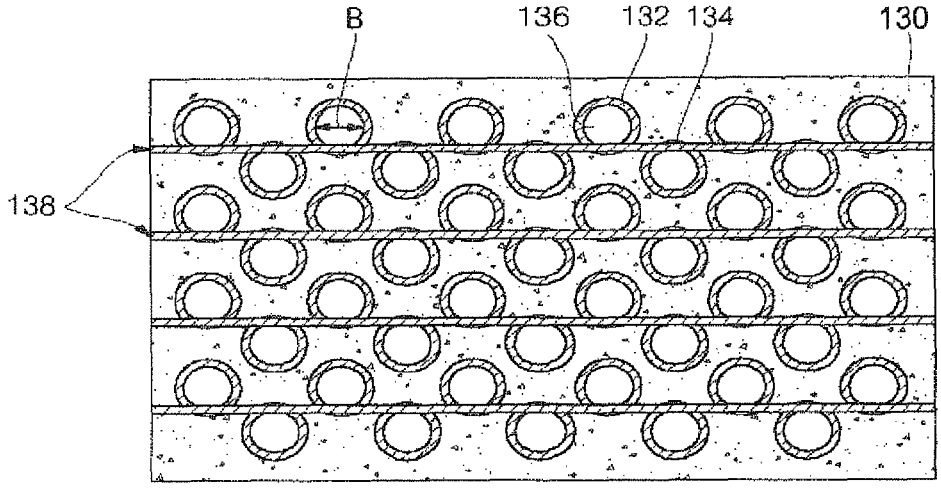
Figure 5:
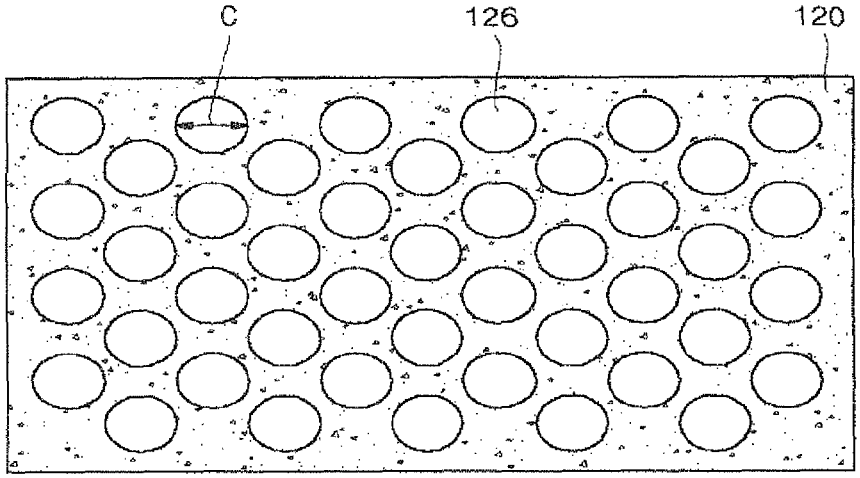

FIGS. 3 through 5 are plan views of an upper electrode layer, a lower electrode layer, and a dielectric layer of the PDP according to the embodiment of the present invention, respectively.

First, in order to reduce parasitic capacitance, electrode portions except the peripheries of perforated holes are removed from the Micro Discharge (MD) structure of FIG. 1. In other words, individual electrodes 112 and 132 surrounding perforated holes 140 and connection portions 114 and 134 for applying voltages to the individual electrodes 112 and 132 are formed, thereby forming a matrix type PDP.

As shown in FIG. 3, the connection portions 114 of an upper electrode layer 110 extend in a horizontal or vertical direction to form a group of first electrodes 118. As shown in FIG. 4, the connection portions 134 of a lower electrode layer 130 extend in a direction perpendicular to the first electrode to form a group of second electrodes 138. In order to form the perforated holes of a dielectric layer 120 in a delta array, each second electrode 138 includes a linear connection portion 134 which extends in a horizontal direction and individual electrodes 132 surrounding the perforated holes which are arranged in a zigzag shape at the upper and lower sides of the linear connection portion 134. The second electrode 138 extends in the horizontal direction and electrode-layer perforated-holes formed in the second electrode are included in a group of perforated holes arranged in the horizontal direction.

The first electrodes are referred to as address electrodes which are connected to the terminals of an address electrode driver, and the second electrodes are referred to as scan electrodes which are connected to the terminals of a scan electrode driver. When a negative voltage is supplied to a first scan electrode located at an uppermost side of FIG. 4, and a positive voltage is supplied to a first address electrode located at a leftmost side and a third address electrode of FIG. 3, a discharge is generated by a potential difference therebetween in the first and second perforated holes in a first row.

Thereafter, when a voltage is supplied to the address electrodes depending on a display portion while voltages are sequentially supplied to second and third scan electrodes, a discharge is generated in a perforated hole. When all of the perforated holes are scanned in this manner, an image can be displayed by an afterimage effect depending on the discharge of each perforated hole.

In FIG. 2, substrates 180 and 190 are provided at the outside of the upper and lower electrode layers 110 and 130 and the inside of the substrates is hermetically sealed. The peripheries of the substrates are sealed. The inside of the substrates forming a discharge space is sealed except for an ejection port (not shown), air in the discharge space is ejected, and a discharge gas is injected into the discharge space with an adequate pressure. Subsequently, the ejection port is sealed. Accordingly, when a voltage is supplied, the electrodes can be prevented from being oxidized by oxygen in air and thus can be prevented from deteriorating. Furthermore, the discharge gas can be used for increasing discharge efficiency and evaporation of the electrode.

Figure 6:
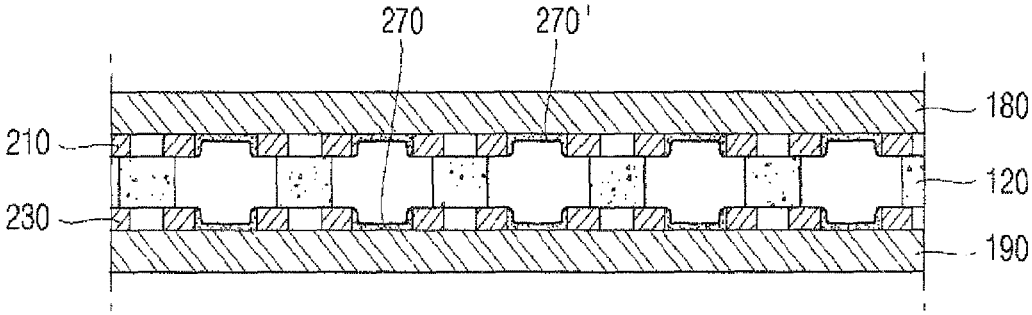
FIG. 6 is a side cross-sectional view of a PDP according to another embodiment of the present invention.

FIG. 6 is a side cross-sectional view of a Plasma Display Panel (PDP) according to another embodiment of the present invention.

The configurations of upper and lower electrode layers 210 and 230, a dielectric layer 120, perforated holes, and substrates 180 and 190 are the same as those of FIG. 2 except for the electrodes. Phosphor layers 270 and 270' (not shown in FIG. 2) can be formed. When the phosphor layers are formed, a color display is improved and the discharge efficiency increased, as compared to emitting light only using the discharge gas.

Referring to FIGS. 3 through 6, when the size C of the perforated hole (dielectric-layer perforated hole) of the dielectric layer 120 is larger than at least one of the sizes A (FIG. 3) and B (FIG. 4) of the perforated holes (electrode-layer perforated holes) of the upper and lower individual electrodes 112 and 132 of the upper and lower electrode layers 210 and 230, the individual electrodes 112 and 132 partially protrude from the dielectric layer 120 and thus the upper and lower individual electrodes 112 and 132 face each other. When a voltage is supplied across the upper and lower electrode layers 210 and 230, a facing discharge is generated. When the facing discharge is generated, a discharge can be generated between the upper and lower electrode layers by a potential difference lower than that of a case where the electrodes are spaced apart from each other at the same interval generate the surface discharge. Thus, the discharge efficiency can be improved.

Even in the present embodiment, the upper substrate 180 and the lower substrate 190 are provided in addition to the basic three-layer structure such that the PDP has durability. A space between the substrates is hermetically sealed by the peripheries of the substrates, and air in the perforated holes is removed, and a discharge gas is injected into the space.

The ends of perforated holes formed in the dielectric layer and the upper and lower electrodes are blocked by the substrates to form a discharge cell space. In the discharge cell, phosphors cover only the sides of the perforated holes in the individual electrodes. As shown in FIG. 6, the phosphor layers 270 and 270' can cover the inner surfaces of the upper and lower substrates 180 and 190, in addition to the upper and lower electrode layers 210 and 230. If the upper substrate 180 configures a screen, the phosphor layer 270' covered on the inner surface of the upper substrate is preferably made of a transparent phosphor.

When laminating the phosphor, the phosphor is not laminated on the facing surfaces of the upper and lower individual electrodes and thus the phosphor can be prevented from deteriorating when the facing discharge is generated. In addition, it is possible to prevent a discharge voltage from being affected by the characteristics of the phosphor, that is, the permittivity of each color of the phosphor.

In order to form the phosphor having the above-mentioned structure, a method of forming an electrode pattern having perforated holes on the substrate and laminating the phosphor in each perforated hole using a printing method has been considered. In consideration of the stepped structure of the substrate on which the phosphor layer is formed, an inkjet ejecting method can be easily applied to the present embodiment, rather than photolithography.

In order to form the structure of FIG. 2 or 6, various methods can be used. For example, one method forms upper and lower electrode layers on upper and lower substrates, inserts, aligns, and laminates a dielectric layer therebetween, and seals the peripheries of the substrates. Alternatively, another method forms separated substrates, upper and lower electrode layers, and a dielectric layer and then aligns and laminates the substrates and the layers in an adequate order, and sealing the peripheries of the substrates. Since manufacturing methods, a laminated material, the connection between electrodes and driving circuits, and circuit configurations are widely known to those skilled in the art in a micro discharge field or a PDP field, a detailed description of their technology has been omitted.

According to the present invention, it is possible to provide a Plasma Display Panel (PDP) having stable characteristics and efficiency of a micro discharge device.

Furthermore, according to the present invention, it is possible to provide a reliable Plasma Display Panel (PDP) having a simple structure.

While the present invention has been particularly shown and described with reference to exemplary embodiments thereof, it will be understood by those skilled in the art that various modifications in form and detail can be made therein without departing from the spirit and scope of the invention as defined by the appended claims.

What is claimed is:

1. A Plasma Display Panel (PDP), comprising:

a dielectric layer having a plurality of dielectric-layer perforated holes arranged in a matrix; and upper and lower electrode layers having electrode-layer perforated holes connected to the dielectric-layer perforated holes and arranged on both surfaces of the dielectric layer;

wherein the upper electrode layer includes a plurality of first electrodes extending in a first direction, the plurality of first electrodes surrounding a group of electrode-layer perforated holes arranged in the first direction;

wherein the lower electrode layer includes a plurality of second electrodes extending in a second direction different from the first direction, the plurality of second electrodes surrounding a group of electrode-layer perforated holes arranged in the second direction;

wherein upper and lower substrates are directly attached to the upper and lower electrode layers, respectively, and wherein a phosphor layer is arranged on the inner surfaces of the electrode-layer perforated holes of at least one of the upper and lower electrode layers and the inner surfaces of the substrates facing the electrode-layer perforated holes, the inner surface of the electrode-layer perforated hole being a surface of the electrode-layer perforated hole that is facing a longitudinal axis of the electrode-layer perforated hole.

2. The PDP according to claim 1, wherein at least one of each first electrode and each second electrode includes individual electrodes surrounding the electrode-layer perforated holes and a connection portion to connect the individual electrodes.

3. The PDP according to claim 1, wherein the dielectric-layer perforated holes are arranged in either a lattice array or a delta array.

4. The PDP according to claim 1, wherein peripheries of the upper and lower substrates hermetically seal a space between the upper and lower substrates, and a discharge gas is contained within the space between the upper and lower substrates.

5. The PDP according to claim 1, wherein the phosphor layer is arranged on at least portions of the upper and lower substrates facing the perforated holes.

6. The PDP according to claim 1, wherein the size of the dielectric-layer perforated holes is greater than that of the electrode-layer perforated holes such that at least portions of the upper and lower electrode layers protrude from the inner surfaces of the dielectric-layer perforated holes toward the centers of the dielectric-layer perforated holes.

7. The PDP according to claim 1, wherein the phosphor layer is arranged only on the inner surfaces of the electrode-layer perforated holes of at least one of the upper and lower electrode layers and the inner surfaces of the substrates facing the electrode-layer perforated holes.

8. The PDP according to claim 6, wherein the phosphor layer arranged on one of the substrates serving as a visible screen comprises a transparent phosphor layer.

9. The PDP according to claim 1, wherein the phosphor layer is arranged on an entirety of the inner surfaces of the electrode-layer perforated holes of at least one of the upper and lower electrode layers, and on an entirety of the inner surfaces of the substrates facing the electrode-layer perforated holes.

10. A Plasma Display Panel (PDP), comprising:

a dielectric layer having a plurality of dielectric-layer perforated holes arranged in a matrix; and upper and lower electrode layers having electrode-layer perforated holes connected to the dielectric-layer perforated holes and arranged on both surfaces of the dielectric layer;

wherein the upper electrode layer includes a plurality of first electrodes extending in a first direction, the plurality of first electrodes surrounding a group of electrode-layer perforated holes arranged in the first direction;

wherein the lower electrode layer includes a plurality of second electrodes extending in a second direction different from the first direction, the plurality of second electrodes surrounding a group of electrode-layer perforated holes arranged in the second direction;

wherein upper and lower substrates are directly attached to the upper and lower electrode layers, respectively, wherein a phosphor layer is arranged on the inner surfaces of the electrode-layer perforated holes of at least one of the upper and lower electrode layers and the inner surfaces of the substrates facing the electrode-layer perforated holes, the inner surface of the electrode-layer perforated hole being a surface that is facing a longitudinal axis of the electrode-layer perforated hole, and wherein the phosphor layer that is arranged on one of the substrates serving as a visible screen, comprises a transparent phosphor layer.

11. A Plasma Display Panel (PDP), comprising:

a dielectric layer having a plurality of dielectric-layer perforated holes arranged in a matrix; and upper and lower electrode layers having electrode-layer perforated holes connected to the dielectric-layer perforated holes and arranged on both surfaces of the dielectric layer;

wherein the upper electrode layer includes a plurality of first electrodes extending in a first direction, the plurality of first electrodes surrounding a group of electrode-layer perforated holes arranged in the first direction;

wherein the lower electrode layer includes a plurality of second electrodes extending in a second direction different from the first direction, the plurality of second electrodes surrounding a group of electrode-layer perforated holes arranged in the second direction;

wherein upper and lower substrates are directly attached to the upper and lower electrode layers, respectively, wherein a phosphor layer is arranged on the inner surfaces of the electrode-layer perforated holes of at least one of the upper and lower electrode layers and the inner surfaces of the substrates facing the electrode-layer perforated holes, the inner surface of the electrode-layer perforated hole being a surface that is facing a longitudinal axis of the electrode-layer perforated hole, and wherein the phosphor layer is not arranged on facing surfaces of the upper and lower electrode layers that are facing each other.

* * * * *